US007489084B2

(12) United States Patent
Kobayashi et al.

(10) Patent No.: US 7,489,084 B2
(45) Date of Patent: Feb. 10, 2009

(54) POWER SUPPLY APPARATUS AND HIGH FREQUENCY CIRCUIT SYSTEM

(75) Inventors: Junichi Kobayashi, Sagamihara (JP); Eiji Fujiwara, Sagamihara (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 113 days.

(21) Appl. No.: 11/668,592

(22) Filed: Jan. 30, 2007

(65) Prior Publication Data

US 2007/0176689 A1 Aug. 2, 2007

(30) Foreign Application Priority Data

Jan. 31, 2006 (JP) ..... 2006-022851

(51) Int. Cl.
*H01J 25/34* (2006.01)

(52) U.S. Cl. ..... 315/3.5; 330/7

(58) Field of Classification Search ..... 315/3.5, 315/5.13, 5, 35, 500, 501; 330/7, 82
See application file for complete search history.

(56) References Cited

U.S. PATENT DOCUMENTS 3,566,180 A * 2/1971 Ewton ..... 315/3.5
4,323,853 A * 4/1982 Kurokawa ..... 330/43
5,744,919 A * 4/1998 Mishin et al. ..... 315/505

FOREIGN PATENT DOCUMENTS

JP 2005-045478 A 2/2005

* cited by examiner

*Primary Examiner*—Douglas W. Owens
*Assistant Examiner*—Jimmy T Vu
(74) *Attorney, Agent, or Firm*—Sughrue Mion, PLLC

(57) ABSTRACT

A power supply apparatus for supplying predetermined supply voltages respectively to an anode electrode, a cathode electrode, a collector electrode, and a helix of an electron tube. The power supply apparatus comprises an anode switch for turning on/off the anode voltage output, and an anode switch control circuit for controlling the on/off operation of the anode switch such that a pulsed anode voltage is repeatedly applied to the anode electrode a plurality of times at a predetermined period when operation of a helix power supply and a collector power supply is stopped.

5 Claims, 4 Drawing Sheets

POWER SUPPLY APPARATUS AND HIGH FREQUENCY CIRCUIT SYSTEM

This application is based upon and claims the benefit of priority from Japanese Patent Application No. 2006-022851 filed on Jan. 31 2006, the content of which is incorporated by reference.

BACKGROUND OF THE INVENTION

1. Field of the Invention

The present invention relates to a power supply apparatus for supplying predetermined supply voltages to a traveling-wave tube used to amplify and oscillate a high frequency signal, and a high frequency circuit system which comprises the power supply apparatus.

2. Description of the Related Art

A traveling-wave tube, a klystron and the like are electron tubes for amplifying or oscillating a high frequency signal by means of the interaction between an electron beam that is emitted from an electron gun and a high frequency circuit. For example, as illustrated in FIG. 1, traveling-wave tube 1 comprises electron gun 10 for emitting electron beam 50, helix 20 which is a high frequency circuit for causing electron beam 50 emitted from electron gun 10 to interact with a high frequency signal (microwave), collector electrode 30 for capturing electron beam 50 delivered from helix 20, and anode electrode 40 for extracting electrons from electron gun 10 to guide electron beam 50 emitted from electron gun 10 into helix 20.

Electron gun 10 comprises cathode electrode 11 for emitting thermoelectrons, heater 12 for applying thermal energy to cathode electrode 11 for emitting thermoelectrons, and Welnelt electrode 13 for converging electrons to form electron beam 50.

Electron beam 50 emitted from electron gun 10 is accelerated by a potential difference between anode electrode 40 and helix 20 and introduced into helix 20, and travels through helix 20 while interacting with a high frequency signal applied to helix 20. Electron beam 50 exiting helix 20 is captured by collector electrode 30. In this event, helix 20 delivers the high frequency signal which has been amplified by the interaction with electron beam 50.

As illustrated in FIG. 1, power supply apparatus 70 for supplying a predetermined supply voltage to each electrode of traveling-wave tube 1 comprises helix power supply 71 for supplying a negative DC voltage (helix voltage Ehel) to cathode electrode 11 of electron gun 10 on the basis of the potential applied to helix 20, collector power supply 72 for supplying a positive DC voltage (collector voltage Ecol) to collector electrode 30 on the basis of the potential applied to cathode electrode 11, anode power supply 73 for supplying a positive DC voltage (anode voltage Ea) to anode electrode 40 on the basis of the potential applied to cathode electrode 11, and heater power supply 74 for supplying heater voltage Eheat, which is an AC voltage or a DC voltage, to heater 12 of electron gun 10 on the basis of the potential applied to cathode electrode 11. Helix 20 is generally grounded through a connection to the housing of traveling-wave tube 1.

Helix voltage Ehel, collector voltage Ecol, and anode voltage Ea are generated, for example, using a known inverter for boosting the supply voltage fed from the outside, a transformer, a known rectifier comprising a rectifier circuit and a commuting capacitor, and the like.

Discharge bleeder resistors R1, R2 are connected between cathode electrode 11 and helix 20 and between cathode electrode 11 and collector electrode 30, respectively, for discharging electric charges accumulated on commuting capacitors (not shown) when the supply voltage is not fed.

In traveling-wave tube 1 illustrated in FIG. 1, the amount of electrons emitted from cathode electrode 11 can be controlled by anode voltage Ea applied to anode electrode 40, and the power of the high frequency signal delivered from traveling-wave tube 1 can also be controlled by anode voltage Ea. For example, even when traveling-wave tube 1 is applied with a high frequency signal having constant power, a pulsed high frequency signal can be delivered from helix 20 if anode electrode 40 is applied with a pulsed voltage.

In this connection, Japanese Patent Laid-Open No. 2005-45478 describes an example in which an input signal (high frequency signal) applied to traveling-wave tube 1 is detected to adjust anode voltage Ea in accordance with the input power such that the output power is not saturated, thereby improving the power efficiency of the output signal.

In the aforementioned conventional power supply apparatus 70, even if the operation of the inverter that is connected, for example, to the primary side of a transformer contained in the rectifier is stopped, the potentials of helix voltage Ehel and collector voltage Ecol remain as they are unless electric charges accumulated on the commuting capacitor connected to the secondary side of the transformer are discharged using some method. Accordingly, high voltages are maintained though the operation of various power supplies is stopped for testing and maintenance of the traveling-wave tube, klystron and the like. For this reason, maintenance works must be started after these electric charges have been sufficiently discharged.

In this connection, since anode power supply 73 employed herein provides low current supply capabilities, remaining anode voltage Ea, if any, will not cause serious problems. Generally, a load resistor is disposed at an output terminal of anode power supply 73 for stabilizing anode voltage Ea, so that electric charges accumulated on the commuting capacitor are discharged through the load resistor when the operation of anode power supply 73 is stopped.

On the other hand, since helix power supply 71 and collector power supply 72 employed herein provide high current supply capabilities, discharge bleeder resistors R1, R2 are disposed as illustrated in FIG. 1 to discharge electric charges accumulated on the commuting capacitors through discharge bleeder resistors R1, R2. Resistors having relatively large resistances (approximately several MΩ) are used for discharge bleeder resistors R1, R2 in order to reduce the current which flows during operation.

However, in the configuration in which electric charges are discharged using discharge bleeder resistors R1, R2, the electric charges are discharged based on a time constant which is determined by the capacitances of the commuting capacitors and the resistances of discharge bleeder resistors R1, R2 contained in helix power supply 71 and collector power supply 72. This causes a problem that it takes a long time until helix voltage Ehel and collector voltage Ecol become sufficiently low after the operation of power supply apparatus 70 is stopped.

Also, since discharge bleeder resistors R1, R2 have large resistances as mentioned above, they consume a large amount of power even if a small current flows therethrough, thus leading to the need for a larger package size in order to ensure sufficient electric power resistance. This causes a problem that large areas are needed for mounting discharge bleeder resistors R1, R2 which are mainly used only for testing and maintenance.

For reducing the time taken to discharge the electric charges accumulated on the commuting capacitors, it is imagined that the output terminals of helix power supply 71 and collector power supply 72 will be short-circuited to the ground potential using ground rod 75, as illustrated in FIG. 1. However, incorporating ground rod 75 into power supply apparatus 70 creates the problem that a larger area for mounting apparatus 70 is required. In addition, since short circuiting the outputs of helix power supply 71 and collector power supply 72 to the ground potential by using ground rod 75 requires making contact with high voltage (several kV) sites, the safety involved in this work is reduced.

SUMMARY OF THE INVENTION

It is therefore an object of the present invention to provide a power supply apparatus which is capable of discharging charges accumulated in the power supply apparatus during testing and maintenance without using large-size parts, while improving the work safety, and a high frequency circuit system which comprises the power supply apparatus.

To achieve the above object, in the present invention, a power supply apparatus for an electron tube is provided with an anode switch for turning on/off the anode voltage output. Then, the on/off operation of the anode switch is controlled such that a pulsed anode voltage is repeatedly applied to an anode electrode a plurality of times at a predetermined period when operation of the helix power supply and collector power supply is stopped.

In the configuration as described above, when operation of the helix power supply and collector power supply is stopped, electrons are drawn from a cathode electrode in synchronization with the pulsed anode voltage applied to the anode electrode, and the electrons emitted from the cathode electrode flow into the power supply apparatus through the collector electrode or helix. In other words, electric charges accumulated on commuting capacitors of the power supply apparatus are discharged through the collector electrode and helix.

Therefore, the electric charges accumulated on the commuting capacitors can be discharged only by adding a small number of parts to a conventional circuit without the need to employ large discharge bleeder resistors. Consequently, the present invention can improve the safety of operations during testing and maintenance of the electron tube while limiting an increase in the size of the mounting area.

The above and other objects, features, and advantages of the present invention will become apparent from the following description with reference to the accompanying drawings, which illustrate examples of the present invention.

DETAILED DESCRIPTION OF THE PREFERRED EMBODIMENT

Figure 1:
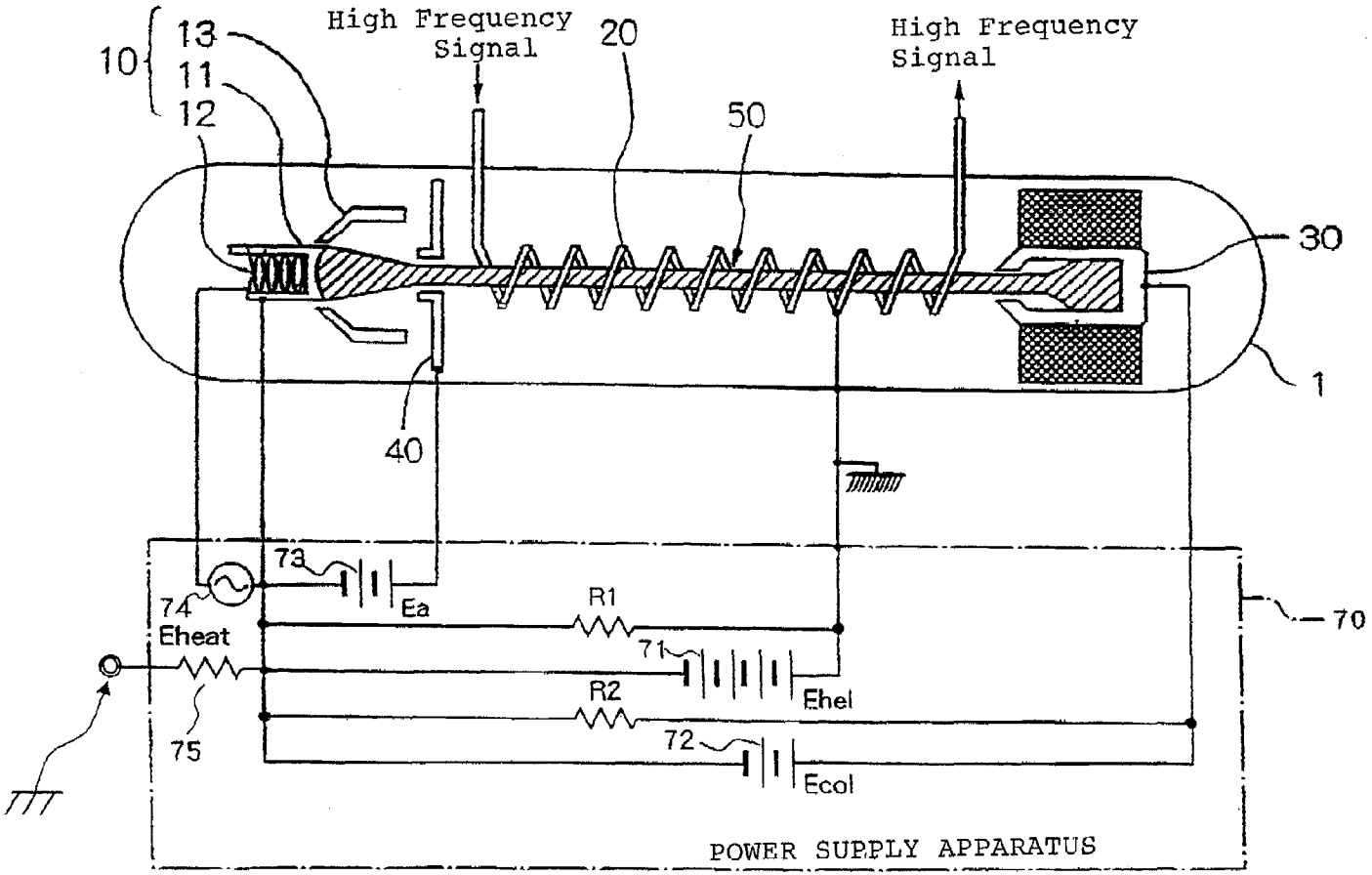
FIG. 1 is a block diagram illustrating the configuration of a conventional traveling-wave tube and power supply apparatus.
Figure 2:
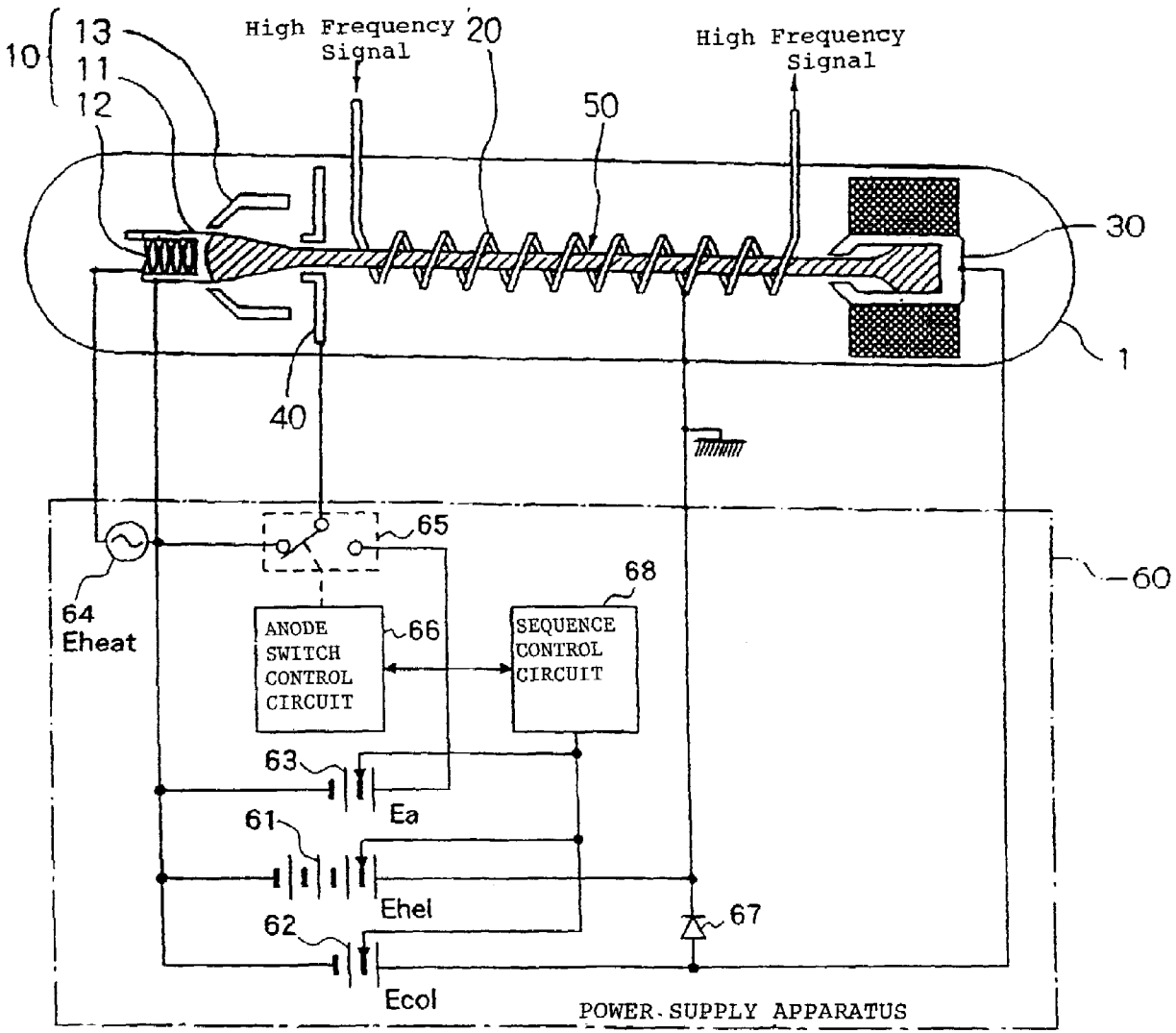
FIG. 2 is a block diagram illustrating an exemplary configuration of a power supply apparatus according to the present invention.
Figure 3:
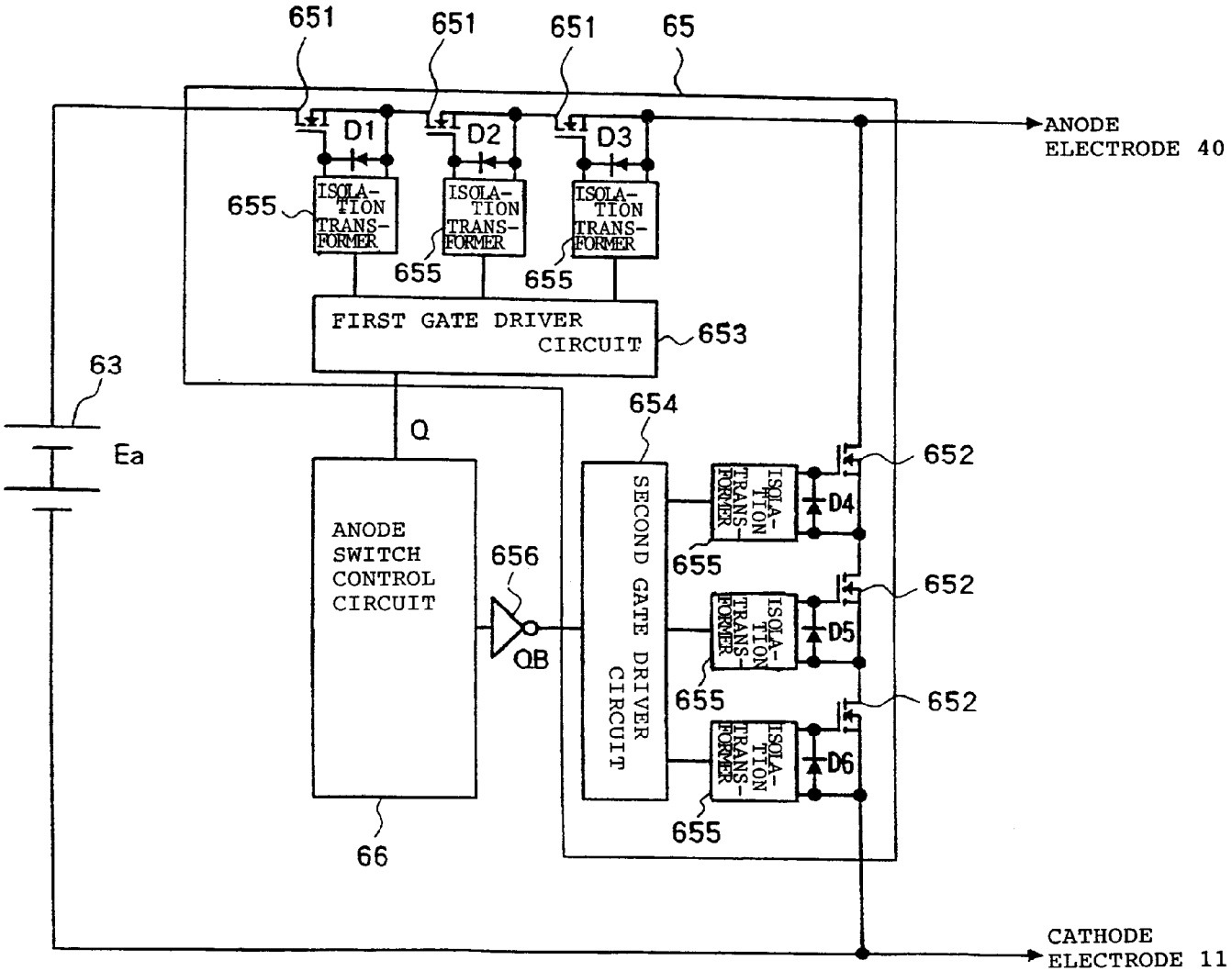
FIG. 3 is a circuit diagram illustrating an embodiment of an anode switch shown in FIG. 2.

FIG. 2 is a block diagram illustrating an exemplary configuration of a power supply apparatus according to the present invention, and FIG. 3 is a circuit diagram illustrating an embodiment of an anode switch shown in FIG. 2. In FIG. 2, traveling-wave tube 1 and components thereof are designated the same reference numerals as those in FIG. 1 which has been referred to in the description of the prior art.

As illustrated in FIG. 2, power supply apparatus 60 of the present invention, like the conventional power supply apparatus, comprises helix power supply 61 for supplying a negative DC voltage (helix voltage Ehel) to cathode electrode 11 of electron gun 10 on the basis of the potential applied to helix 20, collector power supply 62 for supplying a positive DC voltage (collector voltage Ecol) to collector electrode 30 on the basis of the potential applied to cathode electrode 11, anode power supply 63 for supplying a positive DC voltage (anode voltage Ea) to anode electrode 40 on the basis of the potential applied to cathode electrode 11, and heater power supply 64 for supplying heater voltage Eheat, which is an AC voltage or a DC voltage, to heater 12 of electron gun 10 on the basis of the potential applied to cathode electrode 11. Helix 20 is generally grounded through a connection to the housing of traveling-wave tube 1.

Power supply apparatus 60 of the present invention further comprises anode switch 65 for turning on or off the output of anode voltage Ea, anode switch control circuit 66 for controlling the on/off operation of anode switch 65, diode 67 for preventing the voltage between cathode electrode 11 and helix 20 from falling to or below the voltage between cathode electrode 11 and collector electrode 30 when operation of helix power supply 61 and collector power supply 62 is stopped, and sequence control circuit 68 for first turning off anode switch 65 upon cut-off of the supply voltage fed to traveling-wave tube 1, and for controlling the order in which operation of helix power supply 61, collector power supply 62 and anode power supply 63 is stopped.

Anode switch 65 connects anode electrode 40 with cathode electrode 40 under the control of anode switch control circuit 66 when anode switch 65 turns off the output of anode voltage Ea to anode electrode 40.

As illustrated in FIG. 3, anode switch 65 comprises a plurality of high breakdown transistors 651 which are connected in series and inserted between anode electrode 40 and anode power supply 63 of traveling-wave tube 1; a plurality of second high breakdown transistors 652 which are connected in series and inserted between anode electrode 40 and cathode electrode 11 of traveling-wave tube 1; first gate driver circuit 653 for generating a signal for turning on/off first high breakdown transistors 651; second gate driver circuit 654 for generating a signal for turning on/off second high breakdown transistors 652; and a plurality of isolation transformers 655 for applying predetermined gate voltages to first high breakdown transistors 651 and second high breakdown transistors 652, respectively, in accordance with the output signals of first gate driver 653 and second gate driver 654. Diodes D1-D6 are each connected across a gate and a source of each of first high breakdown transistors 651 and second high breakdown transistors 652 to rectify the output voltage (AC) of associated isolation transformer 655.

First gate driver circuit 653 is supplied with control signal Q generated from anode switch control circuit 66, while second gate driver circuit 654 is supplied with control signal QB which is created by inverting control signal Q generated from anode switch control circuit 66 by inverter 656.

First gate driver circuit 653 and second gate driver circuit 654 generate signals (pulse signals) for turning on first high breakdown transistors 651 or second high breakdown transistors 652 in accordance with control signal Q generated from anode switch control circuit 66. The signals generated from first gate driver circuit 653 and second gate driver circuit 654 are applied across the source and gate of first high breakdown transistors 651 and second high breakdown transistors 652 through isolation transformers 655. While FIG. 3 illustrates an example in which three first high breakdown transistors 651 are connected in series between anode electrode 40 and anode power supply 63, and three second high breakdown transistors 652 are connected between anode electrode 40 and cathode electrode 11, the number of first high breakdown transistors 651 and second high breakdown transistors 652 is not limited to three, but anode switch 65 may comprise any number of high breakdown transistors 651 and second high breakdown transistors 652.

Anode switch control circuit 66 controls the on/off operation of anode switch 65 such that pulsed anode voltage Ea is repeatedly applied to anode electrode 40 a plurality of times at a predetermined period when operation of helix power supply 61 and collector power supply 62 is stopped.

Sequence control circuit 68 first instructs anode switch control circuit 66 to turn off anode switch 65 upon cut-off of the supply voltage fed to traveling-wave tube 1, and then stops the operations of helix power supply 61 and collector power supply 62. Sequence control circuit 68 also stops the operation of anode power supply 63 after anode switch control circuit 66 has supplied pulsed anode voltage Ea to anode electrode 40.

Upon cut-off of the supply voltages fed to traveling-wave tube 1, when helix voltage Ehel falls to or below collector voltage Ecol, electrons emitted from cathode electrode 11 can flow into anode power supply 63 through anode electrode 40, possibly causing damage to anode power supply 63. Diode 67 is provided to prevent such damage to anode electrode 63. When it is certain that helix voltage Ehel will not fall to or below collector voltage Ecol earlier than the cut-off of the supply voltages, diode 67 will not be required.

Anode switch control circuit 66 and sequence control circuit 68 may implement their respective functions, for example, with logic circuits. The respective functions may be implemented by a CPU (or DSP) which operates in accordance with a program stored in a memory.

While FIG. 2 illustrates an exemplary traveling-wave tube which comprises one collector electrode 30, traveling-wave tube 1 may comprise a plurality of collector electrodes 30, each of which may be supplied with a different DC voltage. In this configuration, a plurality of collector power supplies 62 may be provided for supplying respective collector electrodes 30 with different collector voltages Ecol, and diode 67 may be inserted between each collector electrode 30 and helix 20 such that diode 67 is oriented in a forward direction from collector electrode 30 to helix 20 as illustrated in FIG. 2.

Also, FIG. 2 illustrates an example in which the operation helix power supply 61, collector power supply 62 and anode power supply 63 is stopped under the control of sequence control circuit 68. However, sequence control circuit 68 may be eliminated if the operations of helix power supply 61 and collector power supply 62 can be stopped first, followed by stopping the operation of anode power supply 63, for example, by the instructions of a testing or a maintenance operator.

Next, the operation of power supply apparatus 60 according to the present invention will be described with reference to FIG. 4.

Figure 4:
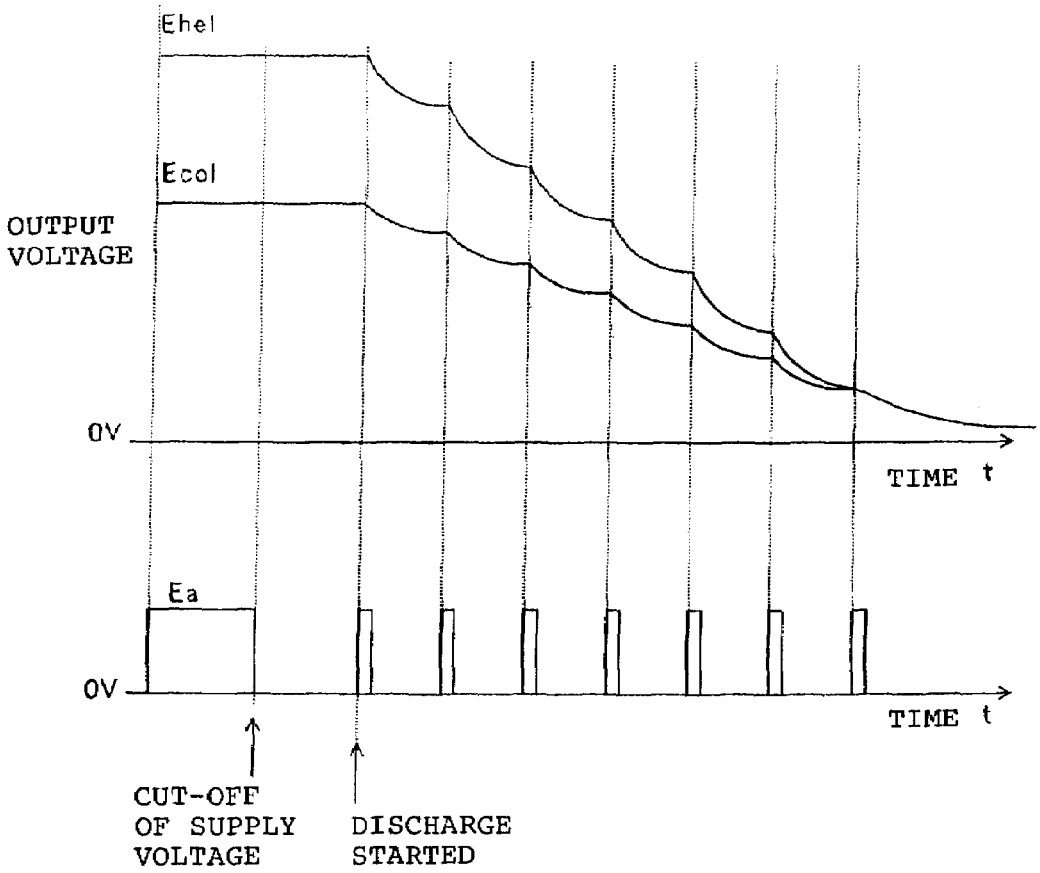
FIG. 4 is a timing chart illustrating changes in output voltages when operation of the power supply apparatus of the present invention is stopped.

FIG. 4 is a timing chart illustrating how the output voltages changes when the power supply apparatus of the present invention has to stop operating. It should be noted that the vertical axis (which represents the output voltages) does not indicate absolute values of helix voltage Ehel, collector voltage Ecol, or anode voltage Ea. FIG. 4 is a schematic diagram which illustrates how the helix voltage Ehel, collector voltage Ecol, and anode voltage Ea change over time.

As illustrated in FIG. 4, upon cut-off of a variety of supply voltages fed to traveling-wave tube 1, sequence control circuit 68 first instructs anode switch control circuit 66 to turn off anode switch 65. Then, sequence control circuit 68 stops the operations of helix power supply 61 and collector power supply 62 which supply helix voltage Ehel and collector voltage Ecol, respectively (cut-off of supply voltage).

When operation of helix power supply 61 and collector power supply 62 is stopped, sequence control circuit 68 transmits an operation stop signal to anode switch control circuit 66 after the lapse of a predetermined time to indicate that operation of helix power supply 61 and collector 62 has stopped (notification of cut-off).

Upon receipt of the cut-off notification from sequence control circuit 68, sequence control circuit 68 controls the on/off operation of anode switch 65 to apply pulsed anode voltage Ea to anode electrode 40 (discharge started). This pulsed anode voltage Ea is repeatedly applied for a plurality of times at a predetermined period until helix voltage Ehel and collector voltage Ecol fall sufficiently (to zero volt, for example). Assume that pulsed anode voltage Ea is applied for a previously set number of times.

When helix power supply 61, collector power supply 62, and anode power supply 63 are controlled to stop operating through instructions of the operator, anode switch control circuit 66 may detect that operation of helix voltage power supply 61 and collector power supply 62 has stopped, and a previously determined number of pulsed anode voltages Ea may be repeatedly applied for a plurality of times at a predetermined period using anode switch 65.

When anode electrode 40 is applied with pulsed anode voltage Ea in this way, electrons are drawn from cathode electrode 11 in synchronization with applied pulsed anode voltage Ea, and the electrons flow into collector power supply 62 or helix power supply 61 thorough collector electrode 30 or helix 20. Consequently, electric charges accumulated on the commuting capacitors of collector power supply 62 and helix power supply 61 are discharged through collector electrode 30 and helix 20.

When pulsed anode voltage Ea has been applied for a previously set number of times, anode switch control circuit 66 notifies sequence control circuit 68 of the completion of the operation (notification of discharge completed). Upon receipt of the discharge completion notification from anode switch control circuit 66, sequence control circuit 68 stops the operation of anode power supply 63.

As described above, in the present invention, electric charges accumulated on the commuting capacitors of collector power supply 62 and helix power supply 61 flow into collector electrode 30 and helix 20 as a current, and are consumed to generate heat. However, since helix 20 is not essentially a device which is flowed by electrons emitted from cathode electrode 11, helix 20 can be damaged, if a large current passes therethrough, due to the energy of the current (power consumption).

Therefore, in the present invention, the period and pulse width of pulsed anode voltage Ea applied to anode electrode 40 are set to such values that do not cause damage to helix 20 even if the application of pulsed anode voltage Ea causes a current to flow through helix 20. Specifically, the period and pulse width of pulsed anode voltage Ea are set to values such that energy generated by a current flowing through helix 20 does not exceed the surge energy withstand capability of helix 20.

According to the present invention, electric charges accumulated on the commuting capacitors of power supply apparatus 60 can be discharged when the supply voltages are cut-off only by adding a small number of parts to a conventional circuit without employing large discharge bleeder resistors. It is therefore possible to improve the work safety during testing and maintenance of traveling-wave tube 1 while limiting an increase in the size of the mounting area.

When a high frequency circuit system comprises traveling-wave tube 1 and power supply apparatus 60 and is configured to generate a pulsed high frequency signal, and when power supply apparatus 60 previously comprises anode switch 65 and anode switch control circuit 66 for controlling the on/off operation of anode switch 65, diode 67 may be provided between collector electrode 30 and helix 20 instead of discharge bleeder resistors R1, R2 shown in FIG. 1 and the circuit configuration, program or the like of anode switch control circuit 66 may be modified such that pulsed anode voltage Ea can be supplied when the supply voltages are cut-off, and sequence control circuit 68 may be provided as required. In this event, electric charges accumulated in the helix power supply and collector power supply can be discharged when the supply voltages are cut-off without substantially changing the size of the existing circuit area.

While a preferred embodiment of the present invention has been described using specific terms, such a description is for illustrative purposes only, and it is to be understood that changes and variations may be made without departing from the spirit or scope of the following claims.

What is claimed is:

1. A power supply apparatus for supplying predetermined voltages respectively to an anode electrode, a cathode electrode, a collector electrode, and a helix contained in an electron tube, said apparatus comprising:

an anode switch for turning on or off an anode voltage output which is a supply voltage fed between said cathode electrode and said anode electrode; and an anode switch control circuit for controlling an on/off operation of said anode switch such that the pulsed anode voltage is repeatedly applied a plurality of times at a predetermined period when the operation of a helix power supply, for supplying a helix voltage which is a supply voltage between said cathode electrode and said helix, is stopped, and when the operation of a collector power supply, for supplying a collector voltage which is a supply voltage between said cathode electrode and said collector electrode, is stopped.

2. The power supply apparatus according to claim 1, further comprising a diode for preventing a voltage between said cathode electrode and said helix from falling to or below a voltage between said cathode electrode and said collector electrode when the operation of supplying voltage from said helix power supply and said collector power supply is stopped.

3. The power supply apparatus according to claim 1, further comprising a sequence control circuit responsive to a cut-off of the supply voltages to said electron tube for first turning off said anode switch, stopping the operation of said helix power supply and said collector power supply, and stopping the operation of said anode power supply for supplying the anode voltage after applying the pulsed anode voltage a plurality of times.

4. The power supply apparatus according to claim 1, wherein said pulsed anode voltage has a time period and a pulse width which are set to values such that energy generated by a current flowing through said helix, due to the application of the pulsed anode voltage, does not exceed the energy surge withstand capability of said helix.

5. A high frequency circuit system comprising:

the power supply apparatus according to claim 1; and a traveling-wave tube supplied with the helix voltage, the collector voltage, and the anode voltage respectively from said power supply apparatus.

* * * * *

UNITED STATES PATENT AND TRADEMARK OFFICE

CERTIFICATE OF CORRECTION

PATENT NO. : 7,489,084 B2
APPLICATION NO. : 11/668592
DATED : February 10, 2009
INVENTOR(S) : Junichi Kobayashi et al.

It is certified that error appears in the above-identified patent and that said Letters Patent is hereby corrected as shown below:

Drawing Figure 1 insert -- RELATED ART --

Signed and Sealed this
Seventh Day of June, 2011

David J. Kappos

David J. Kappos
*Director of the United States Patent and Trademark Office*